US006053404A

United States Patent [19]

Jefferson et al.

[11] Patent Number: 6,053,404

[45] Date of Patent: Apr. 25, 2000

[54] MAIL SIGNALING DEVICE

[76] Inventors: Stuart T. Jefferson, 9207 Ox Rd., Lorton, Va. 22097; Roy F. Ewers, 8411 W. Pointe Dr., Fairfax Station, Va. 22039

[21] Appl. No.: 09/135,803

[22] Filed: Aug. 18, 1998

Related U.S. Application Data

[60] Provisional application No. 60/055,974, Aug. 18, 1997.

[51] Int. Cl.[7] ..... B65D 91/00

[52] U.S. Cl. ..... 232/35; 232/17

[58] Field of Search ..... 232/35, 17, 34, 232/45; 116/173

[56] References Cited

U.S. PATENT DOCUMENTS

| | | | |
|---|---|---|---|
| D. 260,319 | 8/1981 | Kuntz, Jr. . | |
| D. 314,852 | 2/1991 | Taylor . | |
| 2,433,940 | 1/1948 | Weaver | 232/35 |
| 3,482,543 | 12/1969 | Guidos . | |
| 3,596,631 | 8/1971 | Sutton . | |
| 3,968,928 | 7/1976 | Caldwell | 232/35 |
| 4,000,847 | 1/1977 | Duis . | |
| 4,138,056 | 2/1979 | Sherrill | 232/35 |
| 4,171,086 | 10/1979 | Hudson . | |
| 4,491,268 | 1/1985 | Faulkingham | 232/35 |
| 4,524,905 | 6/1985 | Crist . | |
| 4,711,391 | 12/1987 | Roge et al. . | |
| 5,123,590 | 6/1992 | Teele . | |
| 5,366,148 | 11/1994 | Schreckengost . | |
| 5,762,264 | 6/1998 | Ginsberg | 232/35 |

*Primary Examiner*—Terry Lee Melius
*Assistant Examiner*—William L. Miller
*Attorney, Agent, or Firm*—Richard C. Litman

[57] ABSTRACT

An automatic signaling device to be used in conjunction with a standard rural mailbox to indicate that the door has been opened when a mail carrier puts mail in the mailbox. The primary components of the device comprise a signal flag, including a helical spring and a signal plate for attachment to the top end of the spring, a mounting bracket for mounting the helical spring to the door of the mailbox, and a retaining bracket attached to the mailbox top. When in a set, or cocked, position, the spring is bent and the retaining bracket retains the signal plate in a horizontal position over the top of the mailbox. Upon opening the mailbox door to deposit mail, the spring unbends thus permitting the signal plate to be held in a vertical position above the mailbox top when the door is re-shut.

18 Claims, 3 Drawing Sheets

MAIL SIGNALING DEVICE

CROSS-REFERENCE TO RELATED APPLICATION

This application claims the benefit of U.S. Provisional Patent Application Ser. No. 60/055,974, filed Aug. 18, 1997.

BACKGROUND OF THE INVENTION

1. Field of the Invention

The present invention relates generally to automatic mailbox signaling devices mounted to rural or cluster mailboxes, and more specifically to signaling devices whose operative mechanism is spring driven.

2. Description of Related Art

In rural or suburban areas, the mail carrier delivers mail to mailboxes located adjacent to roads and streets which are usually a substantial distance from the houses. The standard rural-type mailbox provides a pivotal flag on its left side which may be raised to indicate to the mail carrier that there is outgoing mail to pick up. Although the mail carrier normally lowers this pivotal flag after the outgoing mail is picked up, the flag often fails to serve as an indicator that incoming mail has been delivered because there may be no outgoing mail, and thus no need to raise the flag in the first place. In this event, there is no means to indicate whether the mail carrier has already been along the route unless an automatic signal flag has also been installed.

In order to be a genuinely practicable option to a potential user, a device which performs the function of automatically indicating that mail has been delivered must meet the following three criteria. First, the device must be sufficiently sturdy—both with regard to its own construction and to the manner in which it is mounted to a mailbox—to ensure perennial, maintenance-free operation. Second, since the user will in most cases desire to mount the device to a pre-existing mailbox, the structure of the device must be such as to require a minimum of modifications to said mailbox. In particular, the need to drill additional holes in a mailbox in order to mount a signaling device will in many instances deter potential users from procuring and installing the device. Third, the device must be easy to operate by the user. In the present instance, this requirement entails that the user be able to engage the signal flag using only one hand, since at the moment of engagement the other hand will generally be occupied with holding the mail which has just been retrieved.

An examination of the related art reveals that a wide variety of mail delivery indicators has been previously proposed. In general, however, these mail delivery indicators fail to satisfy at least one of the above three criteria for viable long-term usage. A first class of devices found in the related art comprises those signaling devices which are sufficiently sturdy in construction and attachment to ensure perennial maintenance-free operation, but which are cumbersome to mount, since their sturdy character owes in large measure to the fact that their attachment to the mailbox requires the drilling of holes in the latter. In this regard, such signal flags fail to satisfy the second criterion laid out above.

Examples of this deficiency in the prior art include the following: U.S. Pat. No. 5,366,148, granted to Schreckengost, describes a side-mounted, spring-driven signal flag with associated latch mechanism, where the mounting of both the latch and the flag requires the fashioning of several holes. U.S. Pat. No. 5,123,590, granted to Teele, exhibits a very similar design to the aforementioned patent in describing a side-mounted, spring-driven signal flag with associated latch mechanism, but this design also requires a hole to be drilled in the door of the mailbox in order to secure the latch. U.S. Pat. No. 4,171,086, granted to Hudson, describes a top-mounted signal flag operated by a gravity-driven pivot mechanism, which likewise requires a sizeable hole to be drilled on top of the mailbox for mounting purposes. U.S. Pat. No. 3,596,631, granted to Sutton, describes a top-mounted, spring-driven signal flag whose top-mounting also requires holes to be pre-drilled. Similar objections apply to the devices described by Kuntz, Jr., in U.S. Pat. No. Des. 260,319, and to Taylor in U.S. Pat. No. Des. 314,852.

Other patented signal flags are simple to mount, but owe this simplicity to a sacrifice in the sturdiness either of the device itself or of the manner in which it is mounted to the mailbox. U.S. Pat. No. 4,711,391, granted to Roge, describes a spring driven signal flag mounted with adhesive to the top of the mailbox, and retained by insertion between the top of the body of the box and the box closure when in the set position. A merely adhesive connection between mail box and signal flag is insufficient, however, given the wide variety of weather extremes to which the signal flag is subjected, as well as the mechanical stresses caused by daily use. Moreover, a spring used in conjunction with a merely adhesive mount will necessarily be weak, so as to preclude the adhesive's being dislodged by the force of the engaged spring, and therefore the latter will also be subject to rapid deterioration. Similar objections apply to U.S. Pat. No. 3,482,543, granted to Guidos, which describes a side-mounted, spring-driven signal flag and associated door-mounted holding latch, both of which are adhesively mounted to the associated mailbox.

Another type of device is described in U.S. Pat. No. 4,524,905, granted to Crist, in which a small flag is mounted to a spring clipped to the top front edge of a mailbox. The spring is necessarily weak, however, due to the fact that it is set by having its top end doubled over and inserted into the box. Consequently, it is also not fit for reliable and extended employment. A very similar deficiency must be attributed to the signal flag described in U.S. Pat. No. 4,000,847, granted to Duis, where the driving spring is itself mounted to the top latch by means of a tied knot connecting the spring to the latch.

An added difficulty with the majority of the devices constituting the related art is that they fail to meet the third criterion laid out above, namely, that the signaling mechanism be simple to engage by the user, requiring as they do the use of two hands in order to be engaged in the set position. This particular deficiency attaches to the devices disclosed in U.S. Pat. No. 5,366,148 (Schreckengost), U.S. Pat. No. 4,711,391 (Roge), U.S. Pat. No. 4,524,905 (Crist), U.S. Pat. No. 4,171,086 (Hudson), U.S. Pat. No. 4,000,847 (Duis), U.S. Pat. No. 3,596,631 (Sutton), and U.S. Pat. No. Des. 314,852 (Taylor).

For these reasons, a need is present for a mailbox signaling device as described by the present invention. Moreover, none of the above inventions and patents, taken either singly or in combination, is seen to describe the present invention as claimed.

SUMMARY OF THE INVENTION

The present invention combines all of the advantages inherent in devices included in the prior art, while eliminating, at least to some extent, the disadvantages. In particular, the present invention is sturdy both in construction and attachment, yet simple to mount in that its attachment utilizes previously existing latch mounts, such as are found in the vast majority of rural mailboxes currently in use. Moreover, the present invention may be engaged with one hand, and is thus simple to use as well.

The primary components of the device include: a signal plate; a helical spring which renders the signal plate visible by propelling it to a location above the top of the box when the device is set and the mailbox door opened; a retaining bracket mounted to the mailbox top which restrains the signal plate when the device is in the cocked, or engaged, position; and a bracket mounted to the door which secures the spring.

Accordingly, it is a principal object of the present invention to provide a means for automatic mail delivery signaling which can be installed on the majority of existing rural mailboxes by using pre-existing friction latch mounts and latch components on the top and door of said mailbox, thus avoiding the need to create new holes.

It is another object of the invention to provide a means for signaling which is both sturdily secured to said mailbox and which is made of durable components, and which will therefore withstand the ravages of inclement weather as well as the stresses of daily use.

Still a further object of the invention is to provide a mechanism which is easily engaged in the set position with one hand, thus leaving free the user's other hand to hold mail which has just been retrieved.

Yet another object of the invention is to provide a signaling device which is safe, and whose operation poses no danger to a mail carrier or other person who engages the signaling device by opening the door of said mailbox while the device is in the set position.

Yet a further object of the invention is to provide a signaling device which is specially adapted for night-time use by providing optional reflective coating on the signaling portion of the device.

Still another object of the invention is to provide a signaling portion of the device which is protected from ice and snow while in the set position by virtue of its location underneath the topmost mounting flange of the device.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
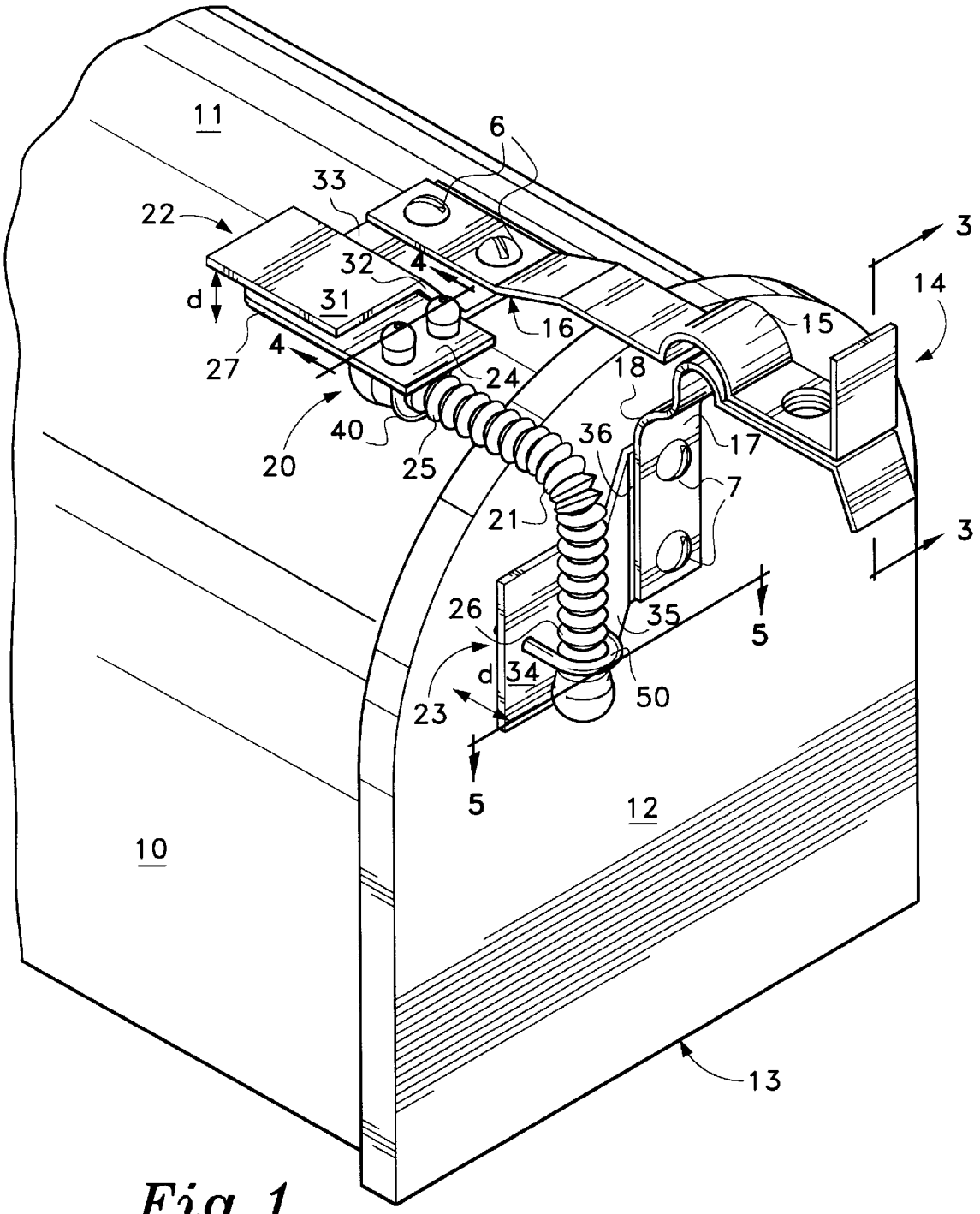
FIG. 1 is an environmental, perspective view of a preferred embodiment of the present invention while in the cocked, or engaged, position.

Turning now to the drawings, FIG. 1 shows a typical outdoor rural mailbox, denoted by the reference numeral 10, from a top, left and front perspective. Mailbox 10 includes a top portion 11, a door 12, and a hinge means 13 connecting the door to the mailbox at the front bottom edge of the top portion 11. The door is held shut when in an upright position by means of a latch mechanism 14 consisting of two components. The first component is an upper latch member 15 having a bottom face 16 which, in the absence of the present invention shown in FIG. 1, would conjoin with top portion 11. The second component of the latch mechanism 14 consists of a lower latch member 17 having a rear face 18 which, in the absence of the present invention shown in FIG. 1, would be attached to the door 12.

In the case of most rural mailboxes, these latch members are each secured to their respective mailbox body components by means of two bolts, each passing through a pair of holes aligned in registry with one another, a first pair of holes defined by and positioned at the appropriate locations on a latch members 15, 17, and a second pair of holes defined by and positioned at the appropriate locations on the associated mailbox top 11 and door 12. The location of the upper assembly pair of holes and bolts is indicated by the numeral 6, and the location of the lower assembly pair of holes and bolts by the numeral 7.

In order to install the signaling device of the present invention, it is necessary to remove the bolts from these locations and then to proceed in the manner to be described below. Removal of the latch attachment bolts is the only modification of the mailbox necessary in order to attach the mail signaling device of the present invention; no additional drilling is required. Thus, the present signaling device is specifically adapted to be compatible with the standard latch attachment scheme found on the majority of the mailboxes currently in service.

The primary components of the mail signaling device itself, comprise the following: a signal plate 20; a helical spring 21 which functions to render the signal plate visible by propelling it to a location above the top of the box when the device is set and the mailbox door 11 opened; a retaining bracket 22 mounted to the mailbox top 11 for the purpose of retaining the signal plate when the device is in the cocked, or engaged, position; and a mounting bracket 23 mounted to the door 12 for the purpose of securing the spring. In general, a lower portion 24 of the signal plate 20 is secured to spring 21 at some point along an upper portion 25 of the spring. The spring 21 and the associated signal plate 20 are secured to the mailbox 10 at some point along a lower portion 26 of the spring by means of the aforementioned mounting bracket 23.

Figure 2:
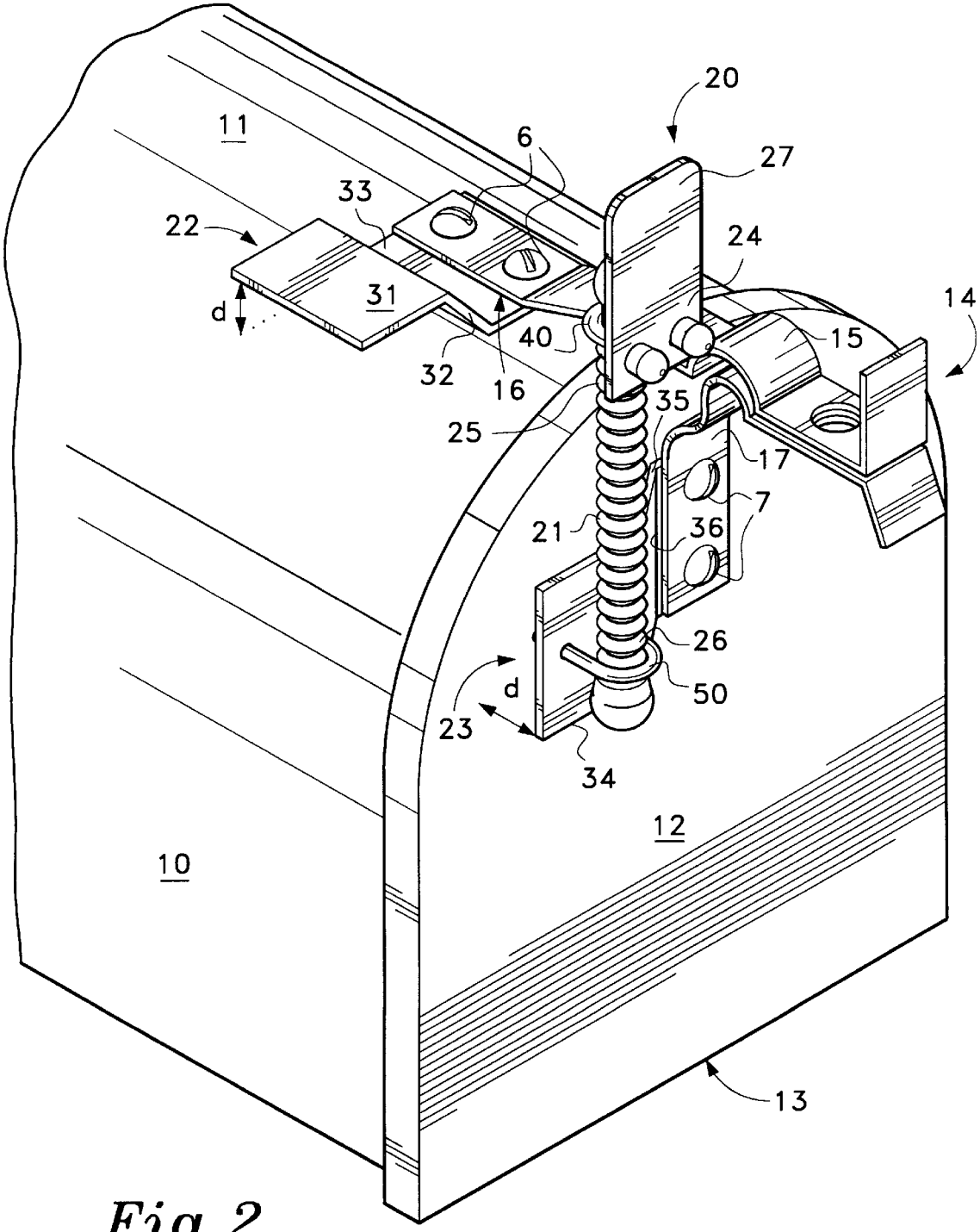
FIG. 2 is an environmental, perspective view of a preferred embodiment of the present invention while in the signaling, or disengaged, position.
Figure 3:
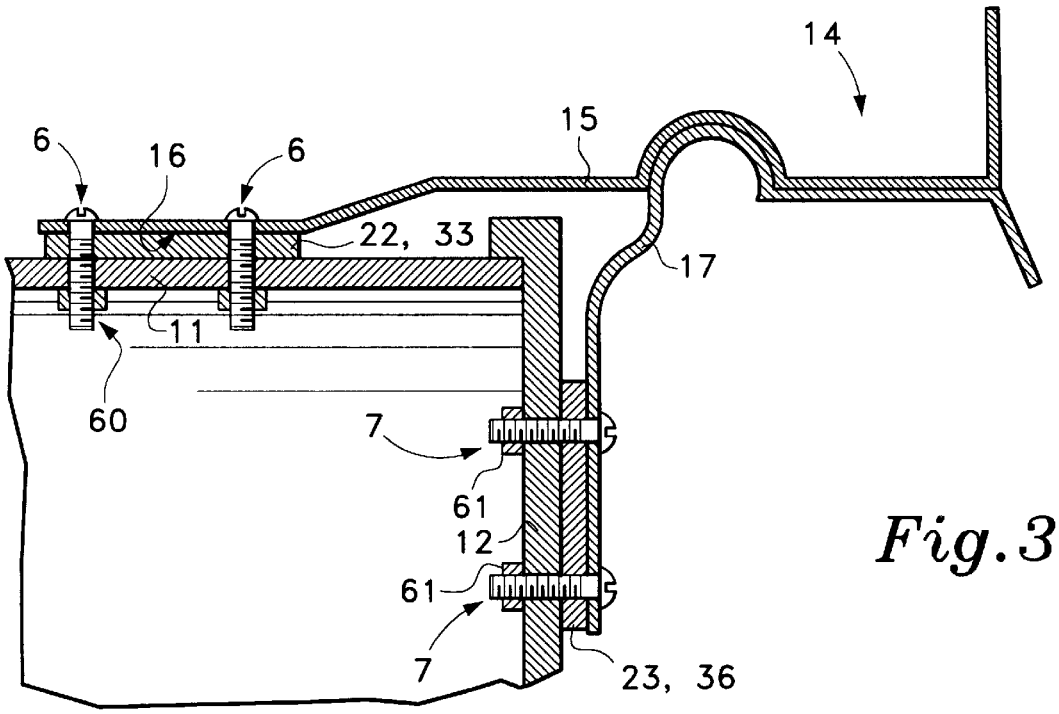
FIG. 3 is an side cross-sectional view drawn along line 3—3 of FIG. 1.

FIGS. 1 and 2 illustrate the shapes of both the retaining bracket 22 and the mounting bracket 23 in their preferred embodiment. As shown, the retaining bracket and the mounting bracket are of rectangular configuration having a pair of bends. As a result, the longer edge of the rectangle is divided into three segments which are roughly of equal length; and the bar defines three distinct planar surfaces corresponding to the aforementioned segments. In FIGS. 1 and 2, the left, center, and right planar surfaces of the retaining bracket 22 have been labeled with the reference numerals 31, 32, and 33, respectively; while the left, center, and right planar surfaces of the mounting bracket 23 are referenced by the numerals 34, 35, and 36.

As depicted, the left and right planar surfaces 31 and 33 of retaining bracket 22 are parallel, but are vertically offset from one another a predetermined distance d as defined by the slope of center planar surface 32. A pair of holes or an elongated slot is formed in surface 33. The holes or slot are designed to be in registry with the bolt holes of the mailbox. This arrangement permits the retaining bracket 22 to be mounted to the mailbox top 11 with its right surface 33 flush with the mailbox top and engaged by the preexisting bolts of the mailbox, while the left surface 31 functions as an overhang under which the upper portion 27 of the signal plate 20 may be engaged.

The mounting bracket 23 is configured similarly to the retaining bracket 22, wherein parallel surfaces 34 and 36 are horizontally offset a predetermined distance d approximating that of the retaining bracket 22. The right surface 36 incorporates a pair of holes or an elongated slot which is in registry with the bolt holes of the mailbox's lower latch component. The mounting bracket 23 is secured to the mailbox door 12 with its right surface 36 attached flush with the surface of the mailbox door and its left surface 34 positioned to overhang the mailbox door to the same side as the overhang of the retaining bracket 22. The left surface 34 provides a mounting surface for attachment of the lower portion 26 of the helical spring, by means later described relative to FIG. 5, directly below the left surface 31 of the retaining bracket 22.

Thus, by comparing FIGS. 1 and 2, the manner in which the device operates will become readily apparent. FIG. 1 depicts the signal flag in the set, or engaged, position, in which the upper portion 27 of the signal plate 20 is retained underneath the left surface 31 of the retaining bracket 22. When the mail carrier opens the mailbox door 12 to insert mail, he or she also causes the signal plate to be pulled out from under the retaining bracket, whereupon the spring 21 recoils to an erect position and causes the signal plate 20 to be propelled to the upright, signaling position, as depicted in FIG. 2. When the mail is subsequently retrieved by the addressee, he or she may very easily place the signal plate in the set position by using one hand to reinsert the signal plate 20 underneath the left surface 31 of the retaining bracket 22. In this way, the addressee's other hand is free to hold the mail which has just been retrieved.

Figure 4:
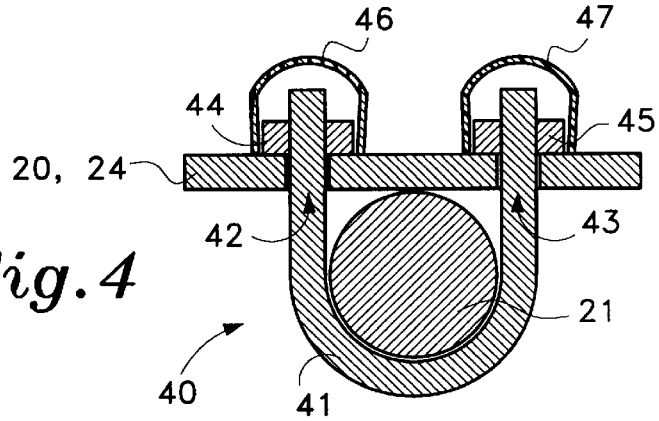
FIG. 4 is a cross-sectional view drawn along line 4—4 of FIG. 1.

FIG. 4, which is a cross-sectional elevation along line 4—4 of FIG. 1, illustrates the preferred means whereby the upper portion 25 of spring 21 is attached to the signal plate 20. The attaching means comprises a U-bracket 40 having a semi-circular middle portion 41 and threaded left and right end portions respectively denoted by 42 and 43. The two ends 42 and 43 of the U-bracket are inserted through two pre-drilled holes defined in the lower portion 24 of the signal plate 20, such that the ends point away from the front of the mailbox 10 when the signaling device is in an upright, or signaling, position. The U-bracket 40 secures the spring to the signal plate by the semi-circular middle portion 14 which closely circumscribes the upper portion 25 of the spring 21. Two nuts 44 and 45 each attach to ends 42 and 43, respectively, to secure the assembly. The forward-facing nuts 44 and 45 are each encased in brightly colored caps 46 and 47, consisting of a soft, pliant material. The decorative caps are also protective in that they act to protect a user who may be directly in front of the mailbox when the spring mechanism causes the signal plate to rise to an erect position. For the same reason, the signal plate 20 is preferably constructed of a relatively soft, light-weight plastic material and is designed to have no sharp edges.

Figure 5:
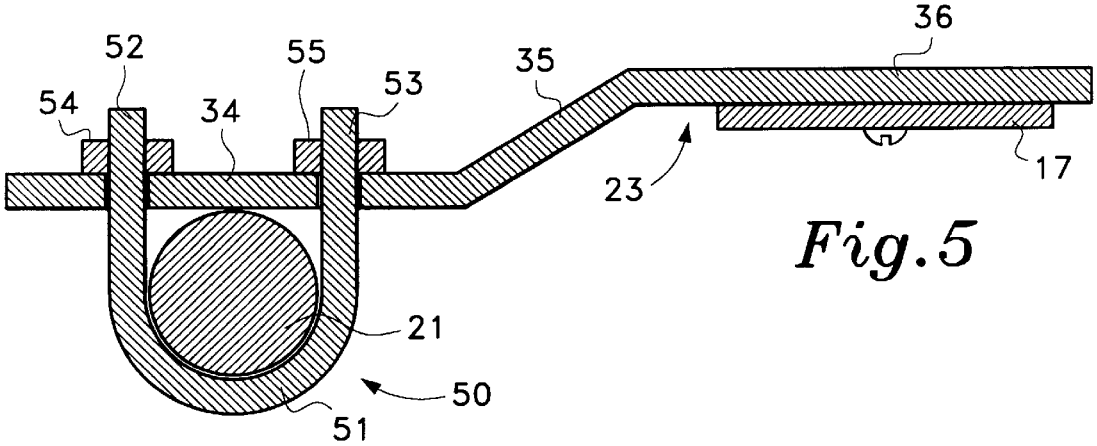
FIG. 5 is a cross-sectional view drawn along line 5—5 of FIG. 1.

FIG. 5 describes the means whereby the lower portion 26 of the spring 21 is secured to the mounting bracket 23. This fastening is accomplished by means of a second U-bracket 50 having a semi-circular middle portion 51, two threaded end portions 52, 53 and two associated nuts, labeled 54 and 55. As similarly described above, the semi-circular middle portion 51 of the U-bracket 50 circumscribes the lower portion 26 of the spring 21, with the ends of the bracket 52 and 53 being inserted through a pair of pre-drilled holes in the left surface 34 of the mounting bracket 23. The assembly is then secured by tightening the nuts 54 and 55 onto ends 52 and 53, respectively. In this instance, the ends 52 and 53 face inward toward the mailbox door 12 in the preferred embodiment, and hence there is no need for a decorative and protective covering.

The means used in the present embodiment to secure the spring 21 both to the signal plate 20 and to the mounting bracket 23 confer the advantage of permitting a user to vary the height of the signal plate over the mailbox. This advantage arises from the fact that the upper portion 25 and the lower portion 26 of the spring 21 are circumscribable by the semi-circular portions 41 and 51 of the U-brackets 40 and 50 at a plurality of points along the length of the spring. As such, the distance between the U-brackets along the length of the spring can be adjusted, thus allowing for variation in the height of the signal plate 20 with respect to the mailbox top 11 when the signal plate is in the upright, signaling position.

A distinctive feature of the present invention, and that which most clearly distinguishes it from the prior art, resides in the manner in which the retaining bracket 22 and the mounting bracket 23 are respectively attached to the mailbox top 11 and the mailbox door 12. In the case of the retaining bracket 22, its right surface 33 is sandwiched between the top 11 of the mailbox 10, and the bottom face 16 of the upper latch member 15. In a similar manner, the right surface 36 of the mounting bracket 23 is installed by being sandwiched between the mailbox door 12, and the rear face 18 of the lower latch member 17. Since the brackets 22 and 23 are designed to utilize pre-existing holes formed in the mailbox, it becomes unnecessary to drill any new holes in order to install the signal plate 20. It is merely necessary to remove the bolts (or rivets) used to secure the mailbox latch components 15 and 17 to the mailbox body attachment points, and then to re-secure them, with the retaining bracket and mounting bracket each inserted in its appropriate location. The new attachment may be secured using either the nuts and bolts originally used to secure the upper latch directly to the mailbox top, or a second set of nuts and bolts which is provided with the signal plate apparatus, in the event that the original nuts and bolts have rusted or been otherwise damaged.

Ancillary features further confer added advantages to the preferred embodiment. First, the upper and lower ends 25 and 26 of helical spring 21 may be covered by brightly colored caps of a soft, pliant material, again for the dual purpose of decoration and protection from the sharp edges to be found at the termination of springs. Second, the front face 27 of the signal plate 20 is preferably of a dark color, so that the device is relatively unobtrusive when viewed from the street or other public location which the mailbox 10 faces. At the same time, the rear face of the signal plate is preferably of a bright color, so as to be easily visible from the rear of the mailbox when the signal flag is in an upright, or signaling, position. The presently described embodiment thus presupposes that the residence from which the signal flag is to be viewed is located to the rear of the mailbox. Finally, the user of the present invention will also be provided with optionally mountable reflective adhesive surfaces. These reflective surfaces are intended for attachment to the rear face of the signal plate 20, for the purpose of facilitating night-time use of the signaling device by means of a flashlight or other artificial light.

The preceding detailed description is based upon a depiction of the present invention in its preferred embodiment. It is to be understood, however, that the materials, shapes, and dimensions of various components in the preferred embodiment may be varied by those skilled in the art without departing from the novelty of the present invention.

Therefore, it is to be understood that the present invention is not limited to the sole embodiment described above, but encompasses any and all embodiments within the scope of the following claims.

We claim:

1. A mail signaling device in combination with a mailbox, said mailbox having a body, said body having mounting holes formed therein, a hinged door attached to said body, said door having mounting holes formed therein, an upper latch member positioned on said body, a lower latch member positioned on said door, said mail signaling device comprising:

a helical spring having an upper end and a lower end;

a retaining bracket having a first horizontal planar surface connected to and vertically offset from a second horizontal planar surface;

a mounting bracket having a first vertical planar surface connected to and horizontally offset from a second vertical planar surface;

a signal plate having a front face and a rear face;

first means for attaching said upper latch member and said retaining bracket to said mailbox body, wherein said first attaching means includes openings formed in said upper latch member and in said retaining bracket's second planar surface, said openings being aligned with said mounting holes in said mailbox body, and fasteners adapted to be inserted through said openings and said mounting holes in said mailbox body;

second means for attaching said lower latch member and said mounting bracket to said mailbox door;

third means for attaching said signal plate adjacent to said upper end of said helical spring; and fourth means for attaching said helical spring, adjacent said lower end thereof, to said mounting bracket.

2. The combination as defined in claim 1, wherein said retaining bracket's second planar surface is sandwiched between said upper latch member and said mailbox body.

3. The combination as defined in claim 1, wherein said second means for attaching includes openings formed in said lower latch member and in said mounting bracket's second planar surface, said openings being aligned with said mounting holes in said door, and fasteners adapted to be inserted through said openings and said mounting holes in said door for securing said lower latch member and said mounting bracket to said door.

4. The combination as defined in claim 3, wherein said mounting bracket's second planar surface is sandwiched between said lower latch member and said door.

5. The combination as defined in claim 1 wherein said third means for attaching includes openings formed in said signal plate, a u-shaped bracket having a semi-circular middle portion and threaded ends, said threaded ends are inserted through said openings formed in said signal plate, said semi-circular middle portion closely circumscribing said helical spring adjacent said upper end, and fasteners received by said threaded ends for securing said signal plate to said helical spring.

6. The combination as defined in claim 5 wherein said fasteners are encased in decorative caps.

7. The combination as defined in claim 6 wherein said decorative caps are made of a soft, pliant material.

8. The combination as defined in 1 wherein said fourth means for attaching includes openings formed in said first vertical planar surface, a u-shaped bracket having a semi-circular middle portion and threaded ends, said threaded ends are inserted through said openings formed in said first vertical planar surface, said semi-circular middle portion closely circumscribing said helical spring adjacent said lower end, and fasteners received by said threaded ends for securing said helical spring to said first vertical planar surface.

9. The combination as defined in claim 1 wherein said retaining bracket's first horizontal surface is positioned relative to said signal plate to maintain said signal plate in a cocked position when said door is closed.

10. The combination as defined in claim 1 wherein said upper and lower ends of said helical spring are encased in brightly colored enclosures made of soft, pliant material.

11. The combination as defined in claim 1 wherein said front face of said signal plate is of a dark color, so as to be unobtrusive when viewed from the front.

12. The combination as defined in claim 11 wherein said rear face of said signal plate is of a bright color, so as to be easily visible from the rear.

13. The combination as defined in claim 1 wherein said rear face of said signal plate includes a reflective outer surface.

14. A mail signaling device for use with a mailbox having a body with mounting holes formed therein, a hinged door attached to the body, mounting holes formed in the door, an upper latch member positioned on the body, and a lower latch member positioned on the door, said mail signaling device comprising:

a helical spring having an upper end and a lower end;

a retaining bracket having a first horizontal planar surface connected to and vertically offset from a second horizontal planar surface;

a mounting bracket having a first vertical planar surface connected to and horizontally offset from a second vertical planar surface;

a signal plate having a front face and a rear face;

first means for attaching the upper latch member and said retaining bracket to the mailbox body;

second means for attaching the lower latch member and said mounting bracket to the mailbox door;

third means for attaching said signal plate adjacent to said upper end of said helical spring, wherein said third attaching means includes openings formed in said signal plate, a U-shaped bracket having a semi-circular middle portion and threaded ends inserted through said openings formed in said signal plate, said semi-circular middle portion closely circumscribing said helical spring adjacent said upper end, and fasteners received by said threaded ends; and fourth means for attaching said helical spring, adjacent said lower end thereof, to said mounting bracket.

15. The device as defined in claim 14, wherein said first means for attaching includes openings formed in said retaining bracket's second planar surface, said openings being positioned for alignment with apertures in the upper latch member and the mounting holes in the mailbox body, and fasteners adapted to be inserted through the apertures in the latch member, said openings in said retaining bracket and the mounting holes in the mailbox body.

16. The device as defined in claim 14, wherein said second means for attaching includes openings formed in said mounting bracket's second planar surface, said openings being positioned for registry with with apertures in the lower latch member and the mounting holes in the door, and fasteners adapted to be inserted through the apertures in the lower latch member, said openings in said mounting bracket and the mounting holes in said door.

17. The device as defined in claim 14 wherein said fasteners are encased in decorative caps.

18. The device as defined in claim 17 wherein said decorative caps are made of a soft, pliant material.

* * * * *